US006076283A

United States Patent [19]

Boie

[11] Patent Number: 6,076,283

[45] **Date of Patent: *Jun. 20, 2000**

[54] SHOES AND SHOE OUTSOLES FOR WET SURFACES

[75] Inventor: Jason C. Boie, Millis, Mass.

[73] Assignee: SRL, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/201,053

[22] Filed: Nov. 30, 1998

[51] Int. Cl.[7] ..... A43B 23/28

[52] U.S. Cl. ..... 36/59 C; 36/114; D2/951; D2/953

[58] Field of Search ..... 36/59 C, 25 R; 30/114; D2/953, 951, 952

[56] References Cited

U.S. PATENT DOCUMENTS

| | | | |
|---|---|---|---|
| D. 255,286 | 6/1980 | Fuzita . | |
| D. 274,956 | 8/1984 | Saruwatari . | |
| D. 290,182 | 6/1987 | Chen . | |
| D. 293,271 | 12/1987 | Lussier . | |
| D. 334,653 | 4/1993 | Mitsui | D2/320 |
| D. 366,354 | 1/1996 | Yoshikawa et al. | D2/953 |
| D. 390,690 | 2/1998 | Murai et al. | D2/953 |
| 3,922,801 | 12/1975 | Zente | 36/44 |
| 4,161,828 | 7/1979 | Benseler et al. | 36/59 C |
| 5,092,060 | 3/1992 | Frachey et al. | 36/29 |
| 5,197,206 | 3/1993 | Shorten | 36/29 |
| 5,325,611 | 7/1994 | Dyer et al. | 36/30 |
| 5,375,346 | 12/1994 | Cole et al. | 36/29 |
| 5,416,986 | 5/1995 | Cole et al. | 36/29 |
| 5,423,135 | 6/1995 | Poole et al. | 36/25 |
| 5,524,364 | 6/1996 | Cole et al. | 36/29 |
| 5,545,463 | 8/1996 | Schmidt et al. | 428/178 |
| 5,647,145 | 7/1997 | Russell et al. | 36/28 |
| 5,716,723 | 2/1998 | Van Cleef et al. | 428/690 |
| 5,862,614 | 1/1999 | Koh | 36/59 C |

*Primary Examiner*—M. D. Patterson
*Attorney, Agent, or Firm*—Fish & Richardson P.C.

[57] ABSTRACT

An outsole is provided having excellent gripping and traction properties on wet surfaces. These properties are achieved by equipping the bottom surface of the outsole with a combination of gripping regions having different gripping characteristics. The gripping regions include (a) regions of siping, oriented in different directions to provide multidirectional traction, and (b) regions of stippling (spaced protuberances).

20 Claims, 11 Drawing Sheets

SHOES AND SHOE OUTSOLES FOR WET SURFACES

The invention relates to shoes and outsoles for shoes especially suited for walking on wet surfaces.

BACKGROUND OF THE INVENTION

Good traction on a flat, dry surface can be provided by a flat outsole made of a rubber or other elastomeric material. However, an outsole of this configuration typically provides poor traction on wet surfaces. To improve traction on wet surfaces, it has been known for many years to provide a pattern of wave-like, e.g., sinusoidal or zigzag, incisions (referred to as "siping") in the bottom surface of the outsole. Siping provides sharp edges when the sole is flexed, which tend to cut through the water and increase grip. It has also been known to provide lines of spaced ridges upon the bottom surface of an outsole, the ridges having sharp edges for gripping the walking surface to improve traction, e.g. upon wet surfaces.

SUMMARY OF THE INVENTION

The present invention provides an outsole having excellent gripping and traction properties on wet surfaces. These properties are achieved by equipping the bottom surface of the outsole with a combination of gripping regions having different gripping characteristics. The gripping regions include (a) regions of siping, oriented in different directions to provide multidirectional traction, and (b) regions of stippling (spaced protuberances).

In one aspect, the invention features a shoe sole defining a shoe outsole surface for gripping engagement upon a wet walking surface, the shoe outsole surface including: (a) channels separating the shoe outsole surface into a plurality of discrete outsole regions, the channels being recessed, relative to the walking surface, from a plane of the shoe outsole surface, thereby to permit flow from beneath the shoe outsole surface of water displaced from the wet walking surface by engagement of the shoe outsole surface thereupon, (b) at least one the outsole region comprising a ridged region having a multiplicity of spaced, generally parallel, ridges defining opposed, sharp, generally elongated gripping edges disposed generally in the plane of the shoe outsole surface for gripping engagement with the wet walking surface during walking motion of the shoe upon the wet walking surface, (c) at least one the outsole region comprising a stippling region having a multiplicity of spaced apart protrusions extending from a base surface toward the walking surface, each protrusion defining a circumferential, walking-surface-engaging edge disposed for gripping engagement with the wet walking surface during walking motion of the shoe upon the wet walking surface, the base surface of the stippling region being recessed, relative to the walking surface, from the plane of the shoe outsole surface, and (d) at least one the outsole region comprising a flat surface region having a relatively smooth, flat surface disposed generally in the plane of the shoe outsole surface for engagement with the wet walking surface during walking motion of the shoe upon the wet walking surface.

Preferably, the ridged region comprises a siping region having a multiplicity of spaced, generally parallel, wave-like incisions defining opposed, sharp, generally elongated gripping edges disposed generally in the plane of the shoe outsole surface for gripping engagement with the wet walking surface during walking motion of the shoe upon the wet walking surface. It is also preferred that the shoe outsole surface comprises a plurality of discrete siping regions separated by the channels, and that each protrusion be cylindrically shaped.

Other features and advantages of the invention will be apparent from the following description of presently preferred embodiments, and from the claims.

DESCRIPTION OF THE PREFERRED EMBODIMENTS

Figures 1, 3, 4, 5:
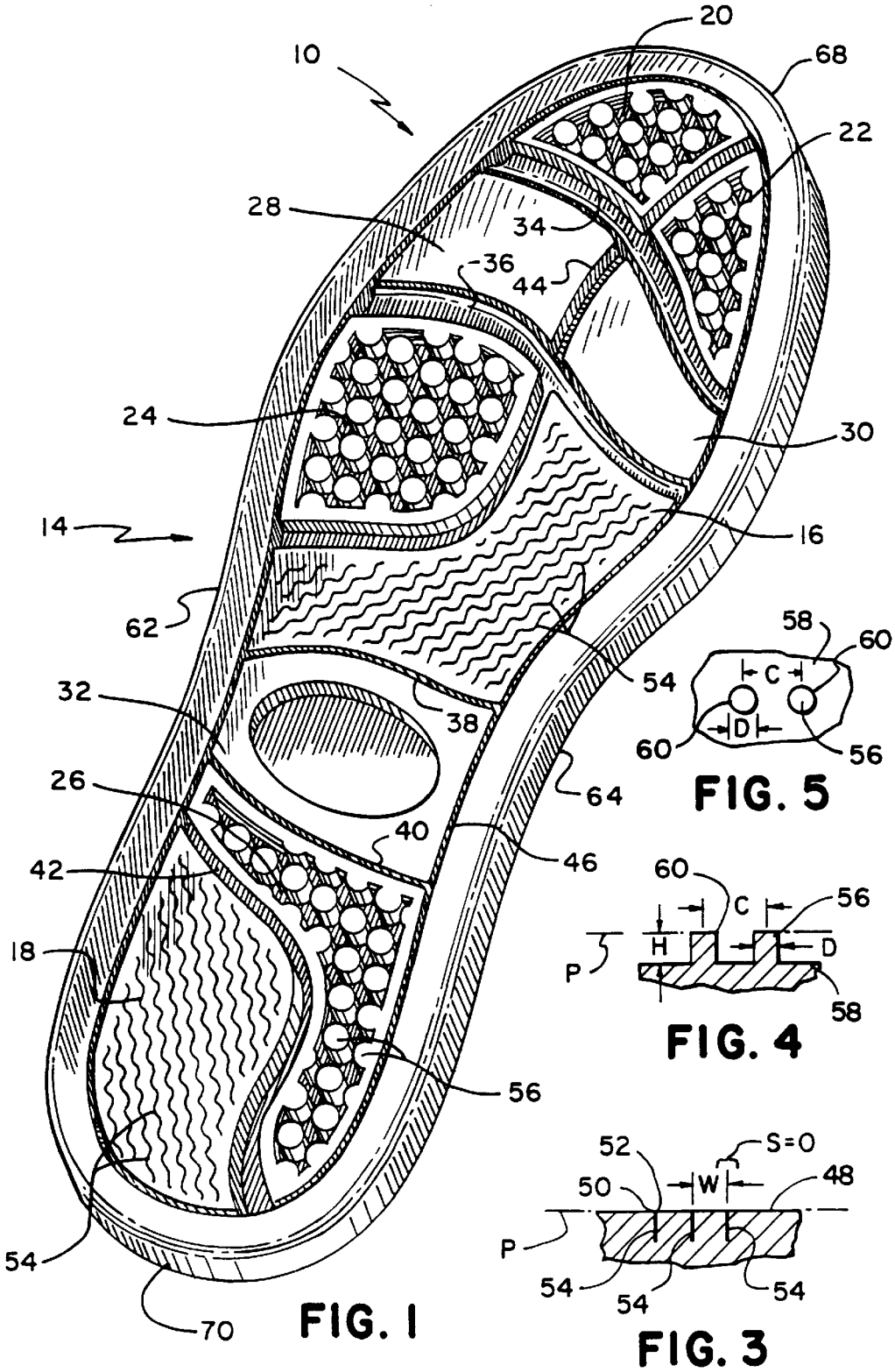
FIG. 1 is a perspective view of a shoe outsole according to one embodiment of the invention.
FIG. 3 is a cross-sectional view in a ridged region of the shoe sole of FIG. 1.
FIGS. 4 and 5 are cross-sectional and plan views, respectively, in a stippled region of the shoe sole of FIG. 1.
Figure 2:
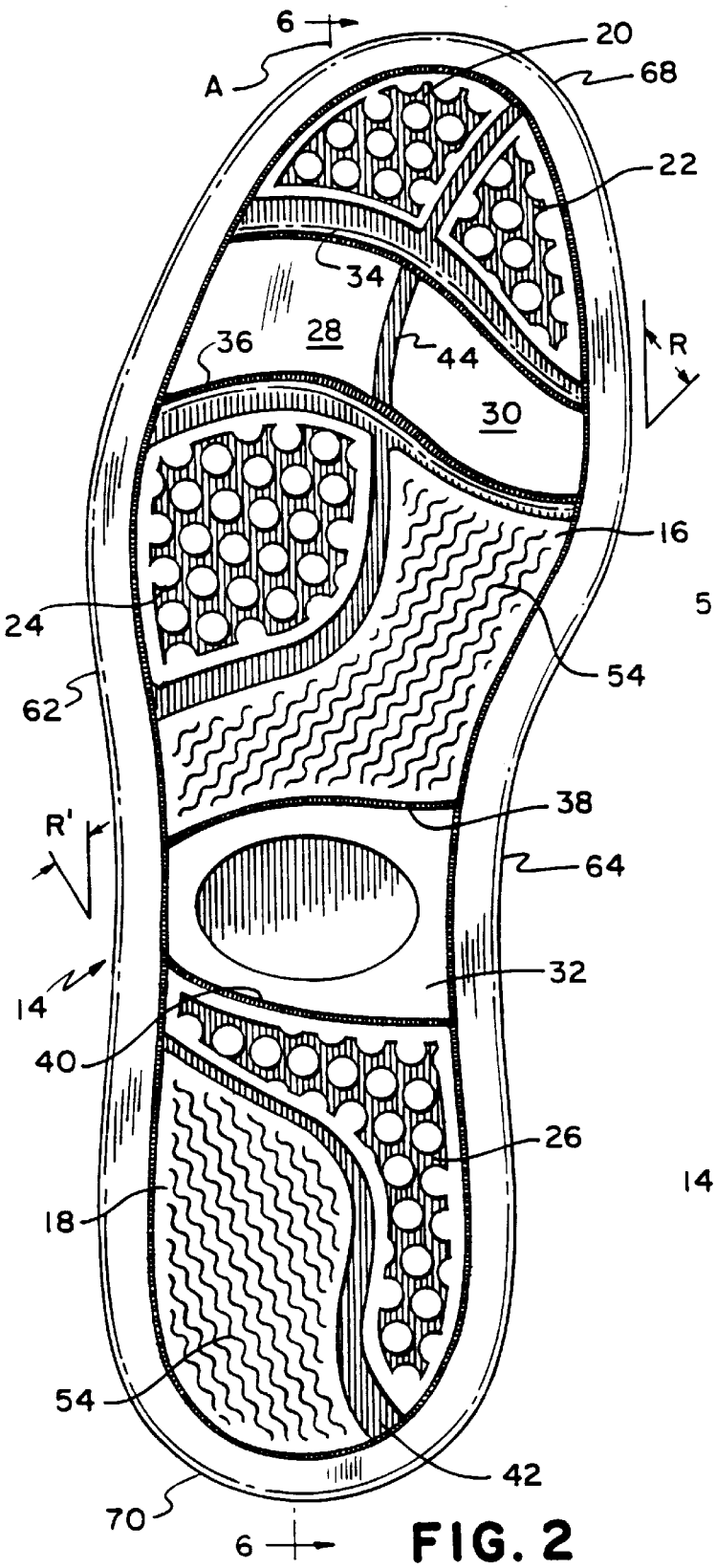
FIG. 2 is a plan view of the shoe outsole of FIG. 1.
Figure 6:
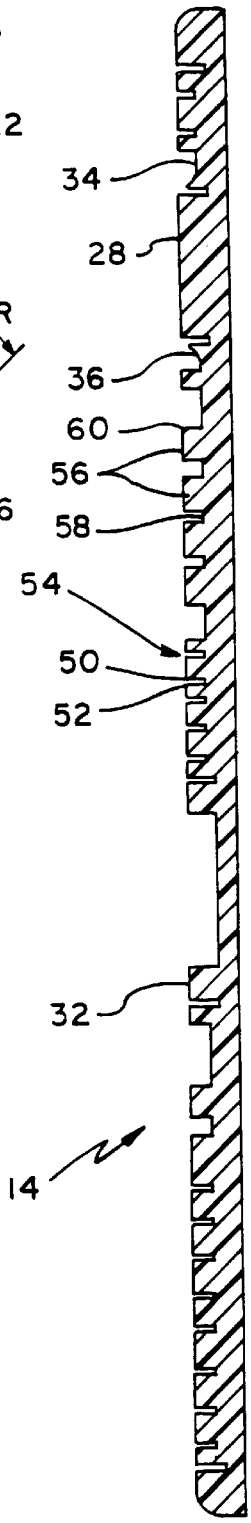
FIG. 6 is a generally longitudinal cross-sectional view of the shoe outsole of FIG. 1, taken along the line 6—6 of FIG. 2.
Figures 7, 9, 10, 11:
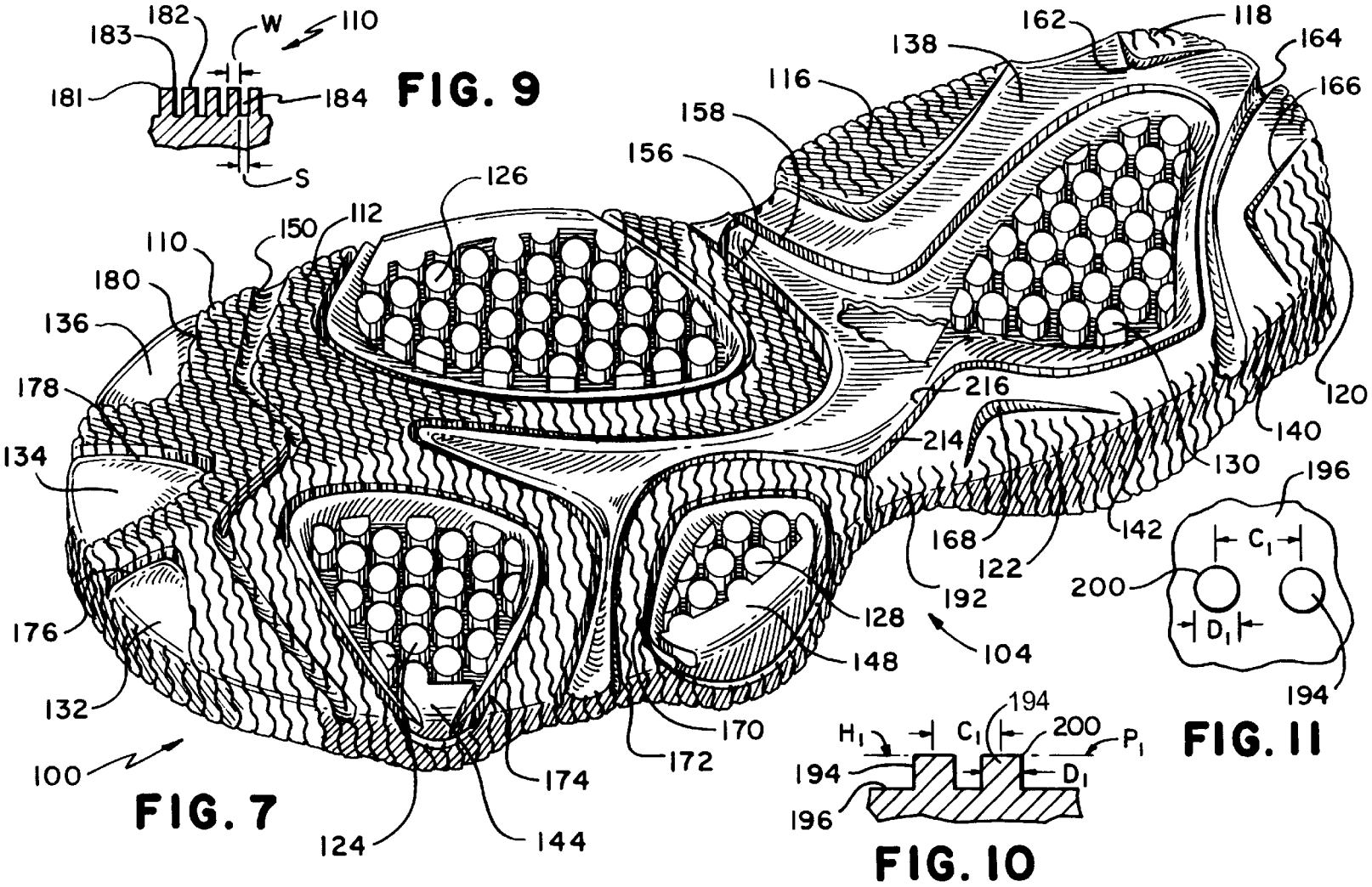
FIG. 7 is a perspective view of another embodiment of a shoe outsole of the invention.
FIG. 9 is a cross-sectional view in a ridged region of the shoe sole of FIG. 7.
FIGS. 10 and 11 are cross-sectional and plan views, respectively, in a stippled region of the shoe sole of FIG. 7.
Figure 8:
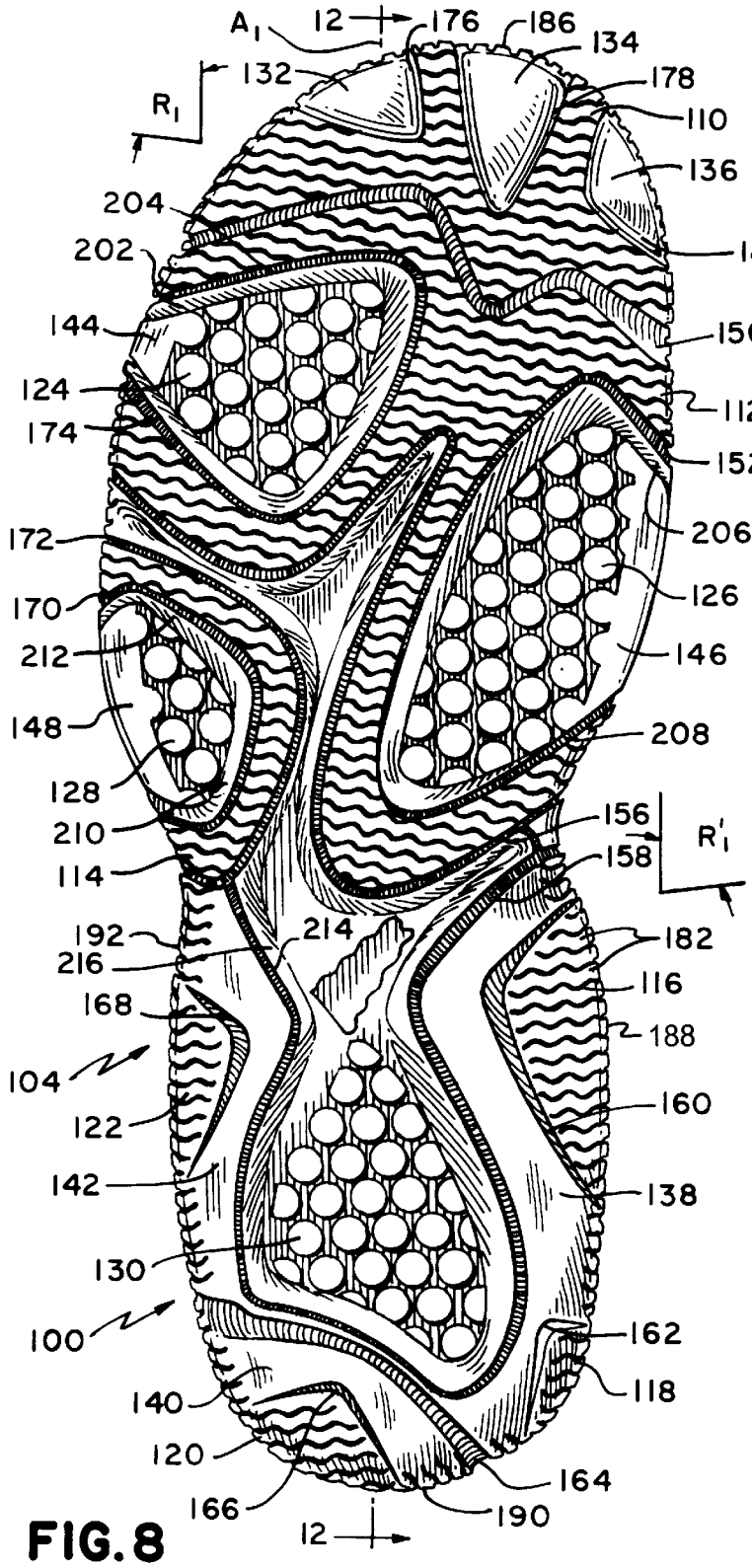
FIG. 8 is a plan view of the shoe outsole of FIG. 7.
Figure 12:
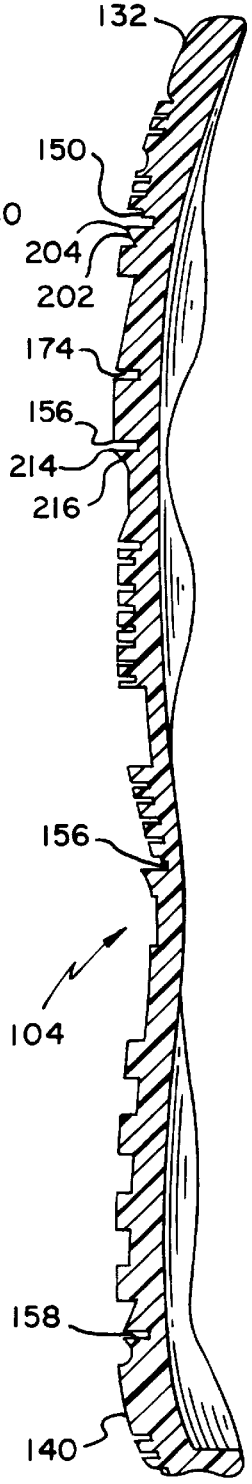
FIG. 12 is a generally longitudinal cross-sectional view of the shoe outsole of FIG. 7, taken along the line 12—12 of FIG. 8.

Referring to FIGS. 1–6, a shoe sole 10 has an outsole surface 14 especially suited for gripping engagement upon a wet walking surface. The outsole surface 14 defines a plurality of outsole regions of differing gripping characteristics, including ridged regions 16, 18, stippled regions 20, 22, 24, 26, and flat surface regions 28, 30, 32 (all of which will be described in more detail below). The discrete outsole regions are defined by channels 34, 36, 38, 40, 42, 44 intersecting at each end with circumferential channel 46.

Each ridged region 16, 18 defines a multiplicity of spaced, generally parallel, ridges 48 which form opposed, sharp, generally elongated gripping edges 50, 52 disposed for gripping engagement with the wet walking surface during walking motion of the shoe upon the wet walking surface. In this particular embodiment, ridged region 16 is located beneath the fore-arch of the wearer's foot and ridged region 18 is located beneath the rear, outside portion of the wearer's heel, and the ridges 48 are formed by a multiplicity of spaced, generally parallel, wave-like incisions, i.e. siping 54. Ridged region 16 is defined by circumferential channel 46 along both side edges, by generally transverse channels 36, 38, and by channel 44 extending from the outside edge 62 to the toe, the channels 36, 38 and 44 all intersecting the circumferential channel 46 at both ends. Ridged region 18 is defined by circumferential channel 46 along the outside edge and heel, and by channel 42 extending from the outside edge 48 to the heel 70, the channel 42 intersecting the circumferential channel 46 at both ends. The ridges 48 in ridged regions 16, 18 have width, W, e.g. about 1 to 2 mm, with a spacing, S, e.g. about 0–1 mm, i.e. the opposed faces of adjacent ridges are in surface-to-surface contact. The ridges 48 in region 16 extend at an angle, R, to the axis, A, while the ridges 48 in region 18 extend at an angle, R', to the axis, A.

The outsole regions also include stippling regions 20, 22, 24, 26 each having a multiplicity of spaced apart cylindrical protrusions 56 extending from a base surface 58 toward the walking surface, each cylindrical protrusion 56 defining a circumferential, walking-surface-engaging edge 60 disposed generally in the plane, P, of the outsole surface for gripping engagement with the wet walking surface during walking motion of the shoe upon the wet walking surface. In this particular embodiment, stippling regions 20, 22 are located beneath the outside portion and inside portion, respectively, of the wearer's toe; stippling region 24 is located beneath the outside portion of the fore-part of the wearer's arch; and stippling region 26 is located beneath the rear-part of the wearer's arch, extending to the inside portion of the heel. Stippling region 20 is defined by circumferential channel 46 along the toe, by generally transverse channel 34, and by channel 44 extending from the outside edge 48 to the toe 68, the channels 34 and 44 both intersecting the circumferential channel 46 at both ends. Stippling region 22 is defined by circumferential channel 46 along the toe, by generally transverse channel 34, and by channel 44 extending from the outside edge 48 to the toe 68, the channels 34 and 44 both intersecting the circumferential channel 46 at both ends. Stippling region 24 is defined by circumferential channel 46 along the outside edge, by generally transverse channel 36, and by channel 44 extending from the outside edge 48 to the toe 68, the channels 36 and 44 both intersecting the circumferential channel 46 at both ends. Stippling region 26 is defined by circumferential channel 46 along the inside edge 64, by generally transverse channel 40, and by channel 42 extending from the outside edge 48 to the heel 70, the channels 40 and 42 both intersecting the circumferential channel 46 at both ends. In one preferred embodiment, the protrusions 56 have a diameter, D, e.g., about 5 to 10 mm, and a height, H, e.g., about 2 to 5 mm, and are arranged with center-to-center spacing, C, e.g., about 5 to 10 mm.

Finally, the outsole regions also include flat surface regions 28, 30, 32, each flat surface region having a relatively smooth, flat surface disposed for engagement with the wet walking surface during walking motion of the shoe upon the wet walking surface. In this particular embodiment, flat surface regions 28 and 30 are located beneath the pad of the wearer's foot, on the outside and inside portions, respectively, and flat surface region 32 is located beneath the arch of the wearer's foot. Flat surface region 28 is defined by generally transverse channels 34, 36, by circumferential channel 26 along the outside edge 48, and by generally transverse channel 46, and by channel 44 extending from the outside edge 48 to the toe 68, the channels 34, 36 and 44 all intersecting the circumferential channel 46 at both ends. Flat surface region 30 is defined by generally transverse channels 34, 36, by circumferential channel 46 along the inside edge 64, and by generally transverse channel 44 extending from the outside edge 62 to the toe 68, the channels 34, 36 and 44 all intersecting the circumferential channel 66 at both ends. Flat surface region 32 is defined by generally transverse channels 38, 40, and by circumferential channel 46 along the outside edge 62 and inside edge 64, the channels 38, 40 both intersecting the circumferential channel 46 at both ends.

As mentioned above, the regions of the outsole surface are separated by channels 34, 36, 38, 40, 42, 44, all of which intersect at both ends with circumferential channel 46, which, in turn, surrounds the regions. The channels serve to allow water to flow from beneath the shoe outsole surface, thereby permitting gripping engagement of the shoe outsole surface with the wet walking surface during walking motion of the shoe upon the wet walking surface. The channels preferably have a depth, measured from the outsole surface, of from 1 to 5 mm.

Referring next to FIGS. 7–12, in another embodiment of the invention, a shoe sole 100 has an outsole surface 104 especially suited for gripping engagement upon a wet walking surface. The outsole surface 104 defines a plurality of outsole regions of differing gripping characteristics, including ridged regions 110, 112, 114, 116, 118, 120, 122; stippled regions 124, 126, 128, 130; and flat surface regions 132, 134, 136, 138, 140, 142, 144, 146, 148 (all of which will be described in more detail below). The discrete outsole regions are defined by channels 150, 152, 154, 156, 158, 160, 162, 164, 166, 168, 170, 172, 174, 176, 178, 180.

Each ridged region 110, 112, 114, 116, 118, 120, 122 defines a multiplicity of spaced, generally parallel, ridges 182 separated by grooves 184, the ridges 182 forming opposed, sharp, generally elongated gripping edges 181, 183 disposed for gripping engagement with the wet walking surface during walking motion of the shoe upon the wet walking surface. In this particular embodiment, ridged region 110 is located beneath the toe of the wearer's foot, ridged region 112 is located beneath the fore part of the wearer's foot, ridged region 114 is located beneath the outside fore-arch region of the wearer's foot, ridged region 116 is located beneath the inside fore-arch region of the wearer's foot, ridged region 118 is located beneath the inside, rear edge of the heel of the wearer's foot, and ridged region 120 is located beneath the outside, rear edge of the heel of the wearer's foot. Ridged region 110 is defined by undulating, generally transverse channel 150 and channels 176, 178 and 180 defining flat regions 132, 134, 136, respectively, along the toe edge 186. Ridged region 112 is defined between undulating, generally transverse channels 150, 152 and by channels 152, 174 around stippling regions 124, 126. Ridged region 114 is defined between channels 170, 172. Ridged region 116 is defined between channel 160 and inside edge 188. Ridged region 118 is defined between chevron channel 162 and heel edge 190. Ridged region 120 is defined between chevron channel 166 and heel edge 190. Ridged region 122 is defined between chevron channel 168 and outside edge 192. The ridges 182 in ridged regions 110, 112, 114, 116, 118, 120, 122 have a width, $W_1$, e.g. about 1 to 3 mm, and the ridges are arranged with a spacing, $S_1$, e.g. about 0 to 2 mm. The ridges 182 beneath the forepart of the wearer's foot (i.e., in ridged regions 110, 112 and 114) extend at an angle, $R_1$, to the axis, $A_1$, while the ridges 182 beneath the rear portion of the wearer's foot (i.e., in ridged regions 116, 118 and 120) extend at an angle, $R_1'$, the axis, $A_1$.

The outsole regions also include stippling regions 124, 126, 128, 130 each having a multiplicity of spaced apart cylindrical protrusions 194 extending from a base surface 196 toward the walking surface, each cylindrical protrusion 194 defining a circumferential, walking-surface-engaging edge 200 disposed generally in the plane, $P_1$, of the outsole surface for gripping engagement with the wet walking surface during walking motion of the shoe upon the wet walking surface. In this particular embodiment, stippling regions 124, 128 are located beneath the outside edge portion of the forepart of the wearer's foot; stippling region 126 is located beneath the inside edge portion of the forepart of the wearer's foot; and stippling region 130 is located beneath the heel of the wearer's foot. Stippling region 124 is defined by channel 174, with surrounding surface 202 sloping from an outer edge 204 generally in plane, $P_1$, into base surface 196. Stippling region 126 is defined by channel 152, with surrounding surface 206 sloping from an outer edge 208 generally in plane, $P_1$, into base surface 196. Stippling region 128 is defined by channel 170, with surrounding surface 210 sloping from an outer edge 212 generally in plane, $P_1$, into base surface 196. Stippling regions 122, 124 and 126 include flat surface regions 144, 146, 148, respectively, extending along the edge. Stippling region 130 is defined by undulating channels 156, 158 and 172, the channels all bounded by an outer edge 214 (generally in plane, $P_1$) of surface 216 surrounding stippling region 130 and sloping from the edge 214 into base surface 196. The protrusions 194 have a diameter, $D_1$, e.g., about 5 to 8 mm, and a height, $H_1$, e.g., about 2 to 5 mm, and are arranged with center-to-center spacing, $C_1$, e.g., about 5 to 10 mm.

Finally, the outsole regions also include flat surface regions 132, 134, 136, 138, 140, 142, 144, 146, 148, each flat surface region having a relatively smooth, flat surface disposed for engagement with the wet walking surface during walking motion of the shoe upon the wet walking surface. In this particular embodiment, flat surface regions 132, 134, 136 are located along the toe edge 176; flat surface regions 138, 142 both extend generally axially from beneath the arch to the heel of the wearer's foot, region 138 lying toward the inside edge 188 and region 142 lying toward the outside edge 192; flat surface region 140 extends generally transversely at the heel, intersecting heel edge 190; flat surface regions 144, 148 extend along the outside edge 192, in stippling regions 124, 128, respectively; and flat surface region 146 extends along the inside edge 188, in stippling region 126. Flat surface region 132 is defined by channel 176 and toe edge 186; flat surface region 134 is defined by channel 178 and toe edge 186; flat surface region 136 is defined by channel 180 and toe edge 186; flat surface region 138 is defined by channels 158, 160, 162, 164; flat surface region 138 is defined by channels 158, 164, 168; and flat surface region 140 is defined by channels 164, 166. Flat surface regions 138, 140 and 142 also define ridges and grooves along the outer edges.

As mentioned above, the regions of the outsole surface are separated by channels 150, 152, 154, 156, 158, 160, 162, 164, 166, 168, 170, 172, 174, 176, 178, and 180. The channels serve to allow water to flow from beneath the shoe outsole surface, thereby permitting gripping engagement of the shoe outsole surface with the wet walking surface during walking motion of the shoe upon the wet walking surface. The channels preferably have a depth of from about 0 to 5 mm.

Figure 13:
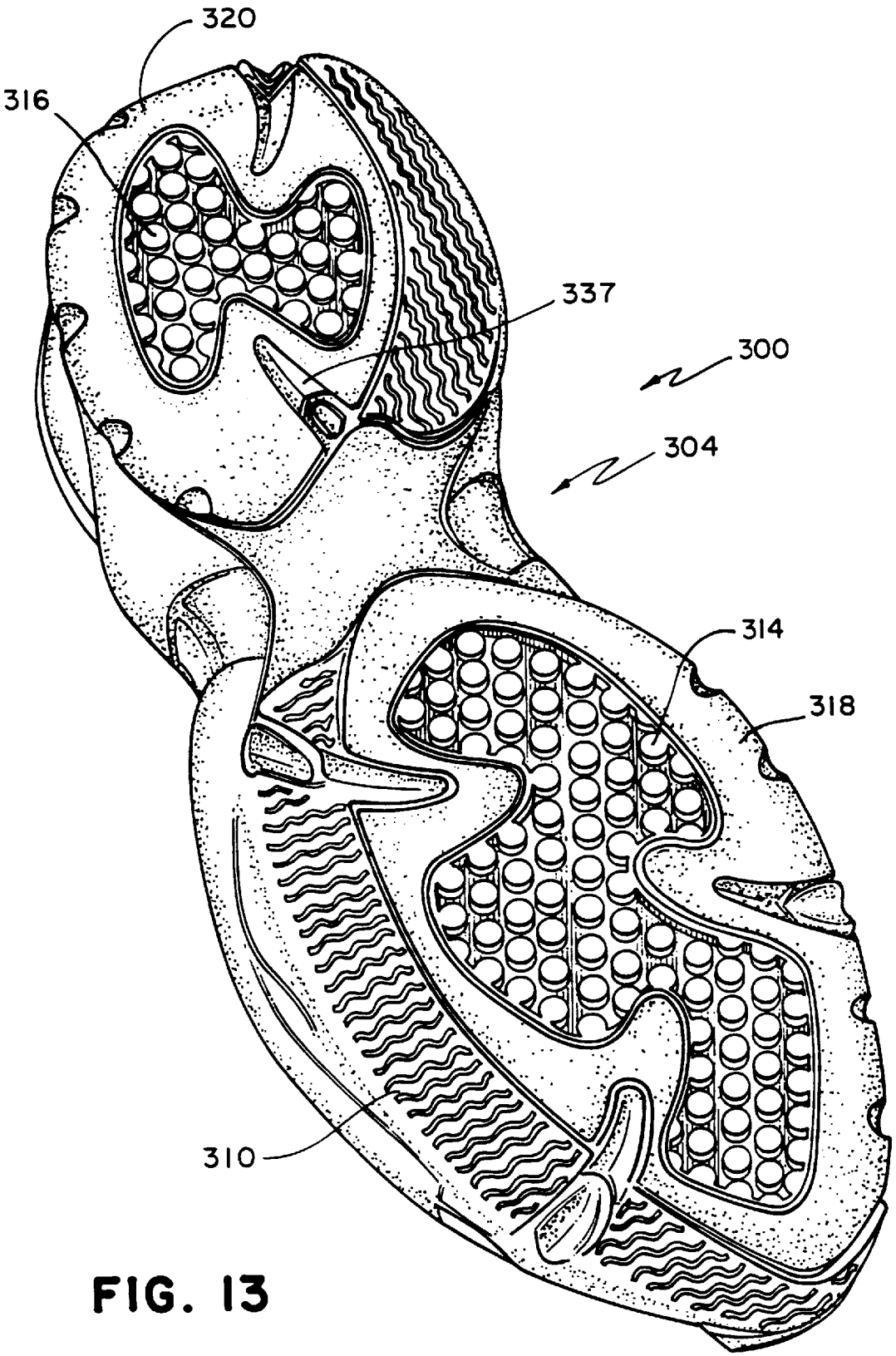
FIG. 13 is a perspective view of another embodiment of a shoe outsole of the invention.
Figure 14:
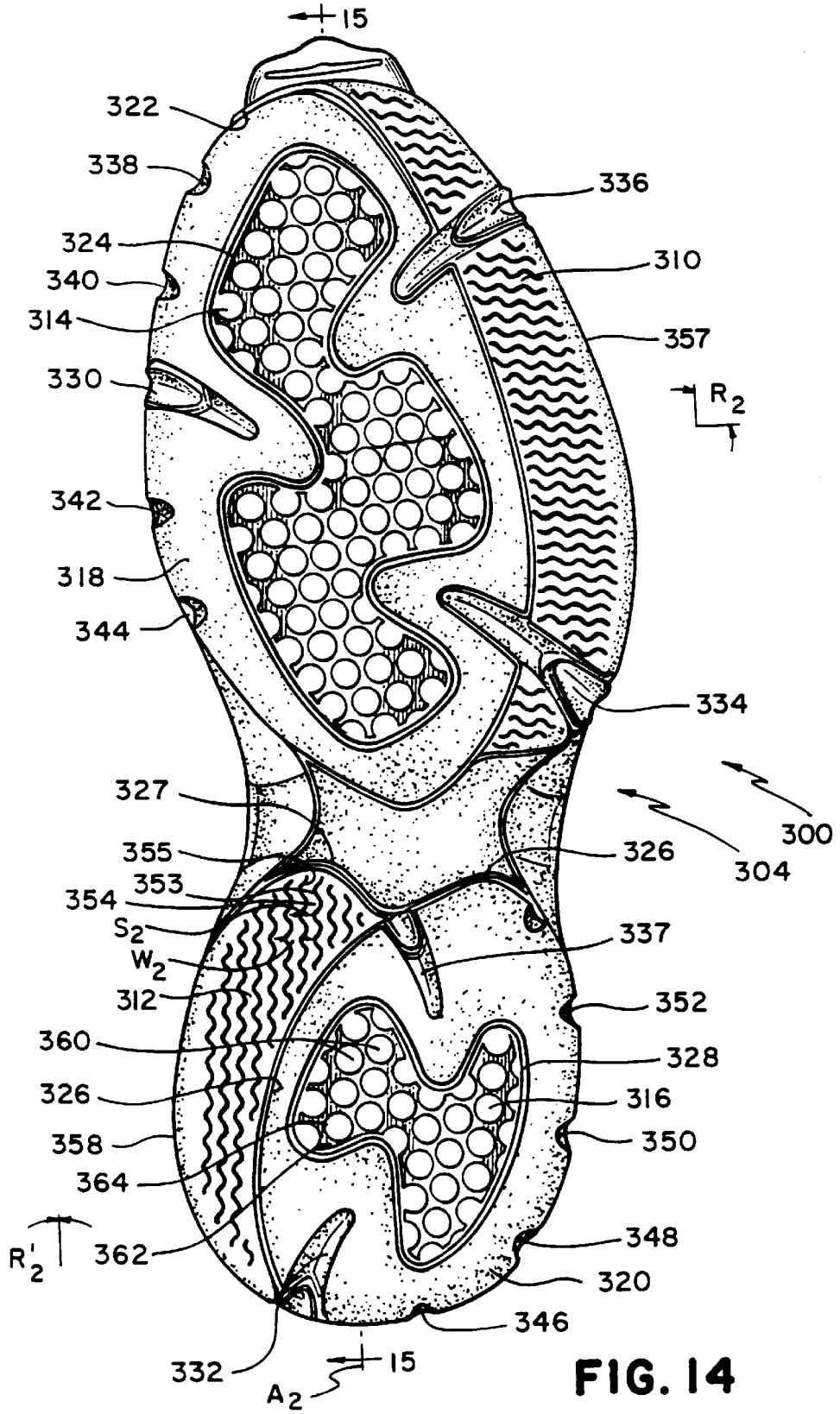
FIG. 14 is a plan view of the shoe outsole of FIG. 13.
Figure 15:
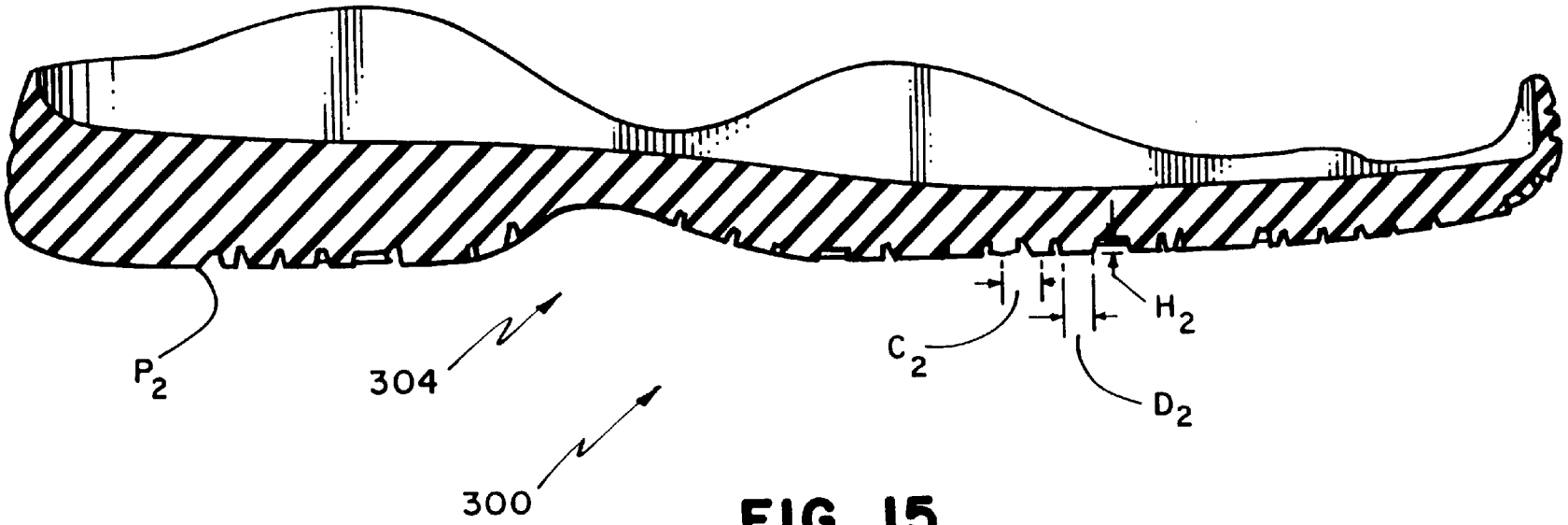
FIG. 15 is a generally longitudinal cross-sectional view of the shoe outsole of FIG. 13, taken along the line 15—15 of FIG. 14.

Referring next to FIGS. 13–15, in another embodiment of the invention, a shoe sole 300 has an outsole surface 304 especially suited for gripping engagement upon a wet walking surface. The outsole surface 304 defines a plurality of outsole regions of differing gripping characteristics, including ridged regions 310, 312; stippled regions 314, 316: and flat surface regions 318, 320 (all of which will be described in more detail below). The discrete outsole regions are defined by channels 322, 324, 326, 327, 328. The shoe sole surface 304 also defines a plurality of notches sloping from the interior of the shoe sole surface toward the outer peripheral edge, including major notches 330, 332, 334, 336 and 337; and lesser notches 338, 340, 342, 344, 346, 348, 350, 352.

Each ridged region 310, 312 defines a multiplicity of spaced, generally parallel, ridges 354 separated by grooves 356, the ridges 354 forming opposed, sharp, generally elongated gripping edges 353, 355 disposed for gripping engagement with the wet walking surface during walking motion of the shoe upon the wet walking surface. In this particular embodiment, ridged region 310 is located beneath the forepart of the wearer's foot along the outside edge 357, and ridged region 312 is located beneath the heel of the wearer's foot along the inside edge 358. Ridged region 310 is defined by channel 322 and edge 356. Ridged region 312 is defined by channels 326, 327 and edge 358. The ridges 354 in ridged regions 310, 312 have a width, $W_2$, e.g. about 2 to 5 mm, and the ridges are arranged with a spacing, $S_2$, e.g. about 0 to 3 mm. The ridges 354 in region 310 beneath the forepart of the wearer's foot extend at an angle, $R_2$, e.g. about +90°, to the axis, $A_2$, while the ridges 354 in region 312 beneath the rear portion of the wearer's foot extend at an angle, $R_2'$, e.g., generally parallel to the axis, $A_2$.

The outsole regions also include stippling regions 314, 316 each having a multiplicity of spaced apart cylindrical protrusions 360 extending from a base surface 362 toward the walking surface, each cylindrical protrusion 360 defining a circumferential, walking-surface-engaging edge 362 disposed generally in the plane, $P_2$, of the outsole surface for gripping engagement with the wet walking surface during walking motion of the shoe upon the wet walking surface. In this particular embodiment, stippling region 314 is located beneath the outside edge portion of the forepart of the wearer's foot and stippling region 316 is located beneath the inside edge portion of the heel of the wearer's foot. Stippling region 314 is defined by channel 324. Stippling region 316 is defined by channel 328. The protrusions 360 have a diameter, $D_2$, e.g., about 5 to 10 mm, and a height, $H_2$, e.g., about 2 to 5 mm, and are arranged with center-to-center spacing, $C_2$, e.g., about 5 to 10 mm.

Finally, the outsole regions also include flat surface regions 318, 320, each flat surface region having a relatively smooth, flat surface disposed for engagement with the wet walking surface during walking motion of the shoe upon the wet walking surface. In this particular embodiment, flat surface region 318 is beneath the forepart of the wearer's foot and flat surface region 320 is located beneath the heel of the wearer's foot. Flat surface region 318 is defined by channels 322, 324 and inside edge 358. Flat surface region 320 is defined by channels 326, 328 and outside edge 357.

As mentioned above, the regions of the outsole surface are separated by channels 322, 324, 326, 327 and 328. The shoe outsole surface also defines notches (major notches 330, 332, 334, 336 and 337; lesser notches 338, 340, 342, 344, 346, 348, 350, 352) sloping from the interior of the shoe sole surface toward the outer peripheral edge. The channels and notches together serve to allow water to flow from beneath the shoe outsole surface, thereby permitting gripping engagement of the shoe outsole surface with the wet walking surface during walking motion of the shoe upon the wet walking surface. The channels preferably have a depth of from 0 to 4 mm, while the major notches have a depth of from 3 to 5 mm, and the minor notches have a depth of from about 3 to 5 mm.

Figure 16:
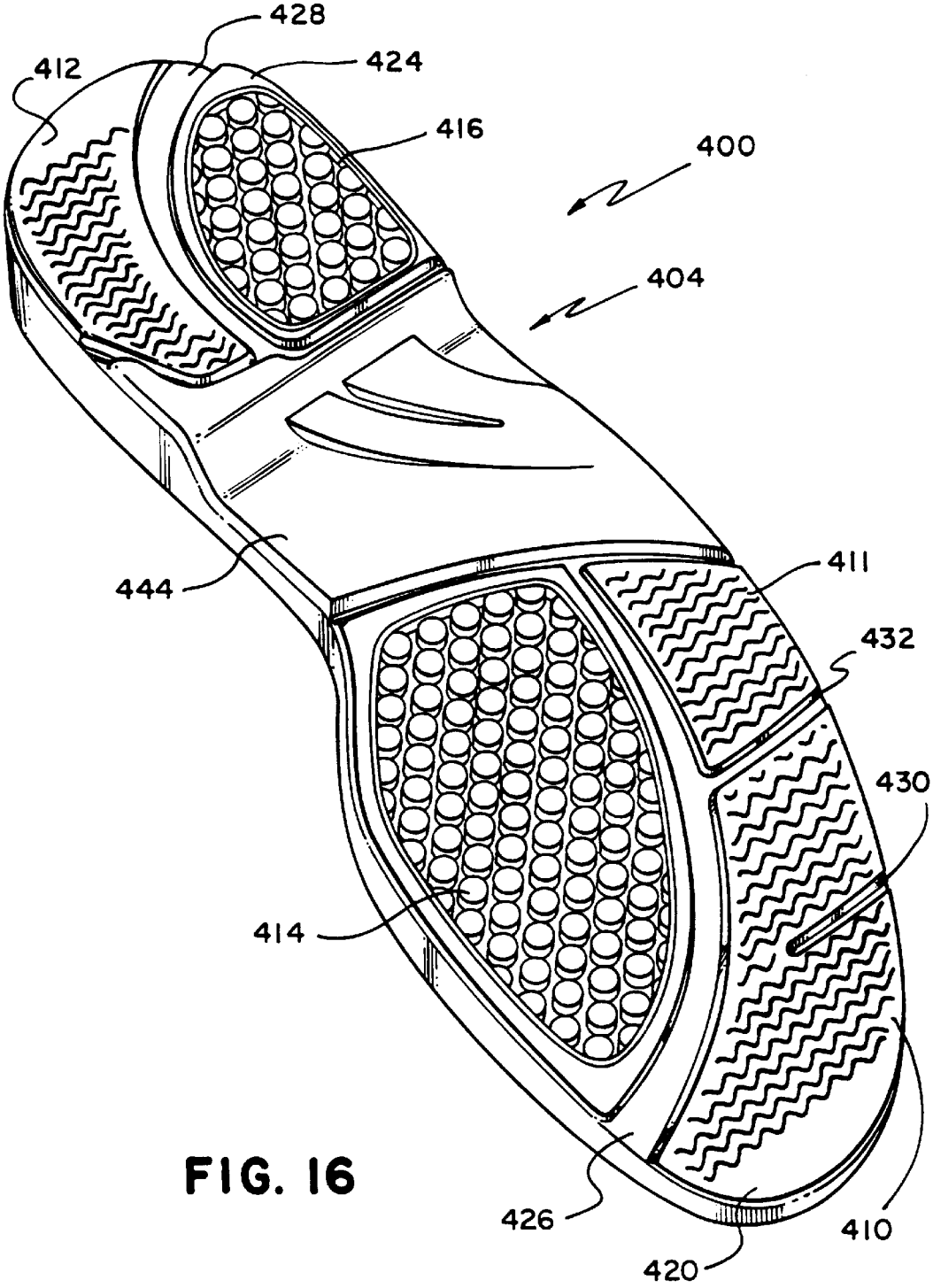
FIG. 16 is a perspective view of another embodiment of a shoe outsole of the invention.
Figure 17:
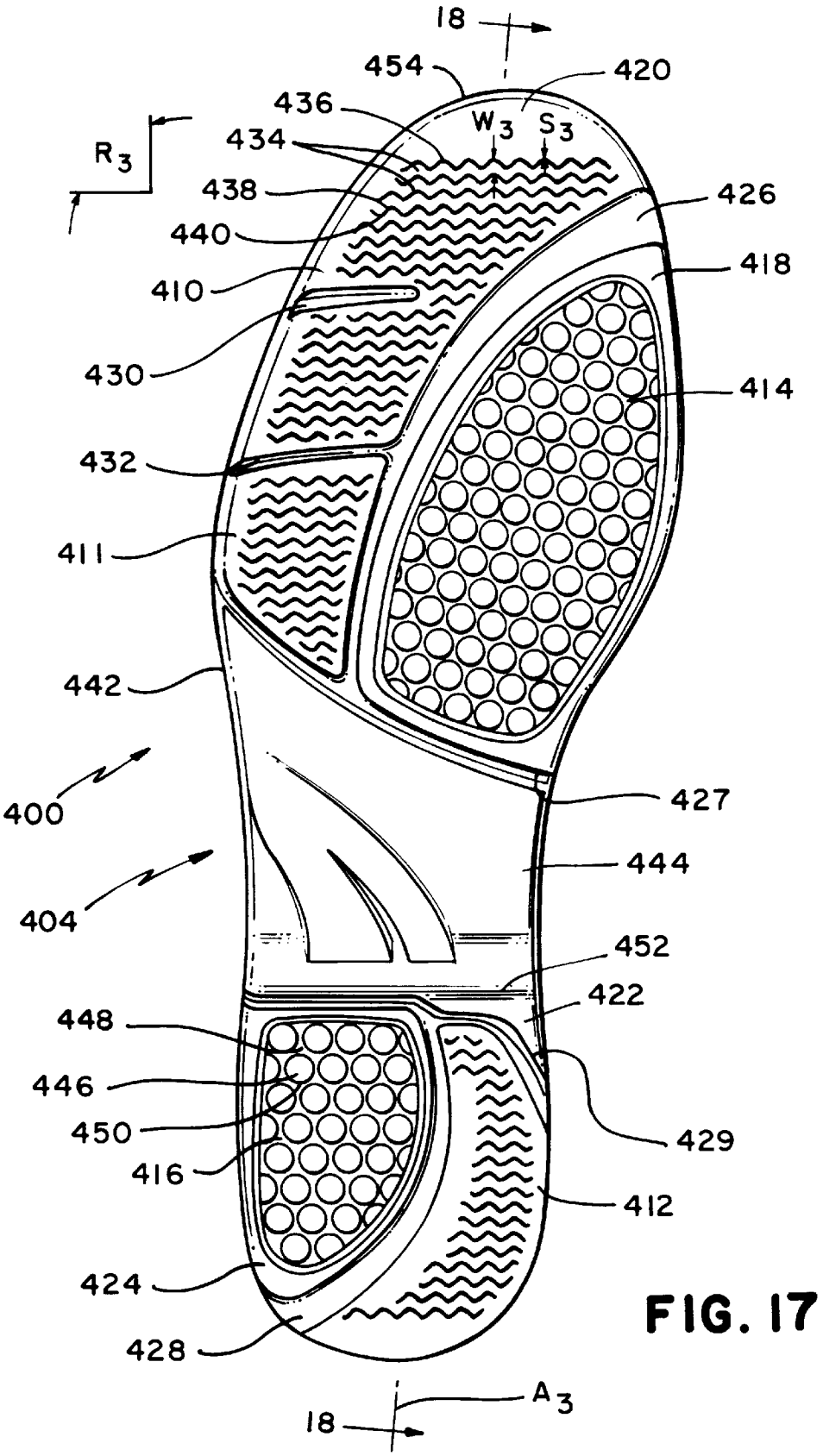
FIG. 17 is a plan view of the shoe outsole of FIG. 16.
Figure 18:
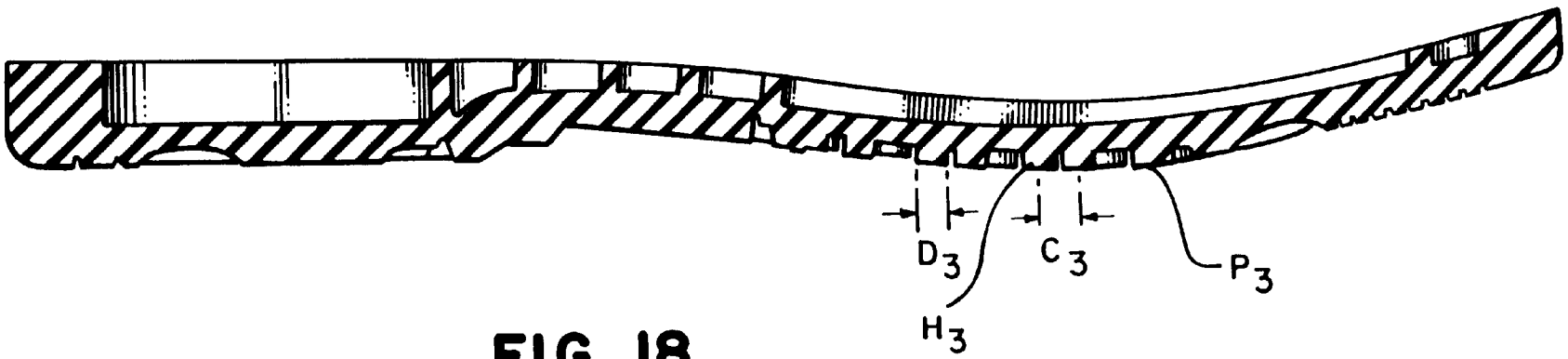
FIG. 18 is a generally longitudinal cross-sectional view of the shoe outsole of FIG. 16, taken along the line 18—18 of FIG. 17.

Referring to FIGS. 16–18, in another embodiment of the invention, a shoe sole 400 has an outsole surface 404 especially suited for gripping engagement upon a wet walking surface. The outsole surface 404 defines a plurality of outsole regions of differing gripping characteristics, including ridged regions 410, 411, 412; stippled regions 414, 416; and flat surface regions 418, 420, 422, 424 (all of which will be described in more detail below). The discrete outsole regions are defined by channels 426, 427, 428, 429. The shoe sole surface 404 also defines notches 430, 432.

Each ridged region 410, 411, 412 defines a multiplicity of spaced, generally parallel, ridges 434 formed by a multiplicity of spaced, generally parallel, wave-like incisions, i.e. siping 436, the ridges 434 forming opposed, sharp, generally elongated gripping edges 438, 440 disposed for gripping engagement with the wet walking surface during walking motion of the shoe upon the wet walking surface. In this particular embodiment, ridged regions 410, 411 are located beneath the forepart of the wearer's foot along the outside edge 442, and ridged region 412 is located beneath the heel of the wearer's foot along the inside edge 444. Ridged region 410 is defined by channel 426 and notches 430, 432. Ridged region 411 is defined by channels 426, 427 and notches 430, 432. Ridged region 412 is defined by channels 428, 429. The ridges 434 in ridged regions 410, 411, 412 have a width, $W_3$, e.g. about 2 to 5 mm, and the ridges are arranged with a spacing, $S_3$, e.g. about 0 to 3 mm, i.e. the opposed faces of adjacent ridges are in surface-to-surface contact. The ridges 434 extend at an angle, $R_3$, e.g., about 90°, to the axis, $A_3$.

The outsole regions also include stippling regions 414, 416 each having a multiplicity of spaced apart cylindrical protrusions 446 extending from a base surface 448 toward the walking surface, each cylindrical protrusion 446 defining a circumferential, walking-surface-engaging edge 450 disposed generally in the plane, $P_3$, of the outsole surface for gripping engagement with the wet walking surface during walking motion of the shoe upon the wet walking surface. In this particular embodiment, stippling region 414 is located beneath the inside edge portion of the forepart of the wearer's foot and stippling region 416 is located beneath the outside edge portion of the heel of the wearer's foot. Stippling region 414 is defined by channel 426. Stippling region 416 is defined by channel 428. The protrusions 446 have a diameter, $D_3$, e.g., about 5 to 10 mm, and a height, $H_3$, e.g., about 2 to 5 mm, and are arranged with center-to-center spacing, $C_3$, e.g., about 5 to 10 mm.

Finally, the outsole regions also include flat surface regions 418, 420, 422, 424, each flat surface region having a relatively smooth, flat surface disposed for engagement with the wet walking surface during walking motion of the shoe upon the wet walking surface. In this particular embodiment, flat surface region 418 is beneath the forepart of the wearer's foot and surrounds stippling region 414; flat surface region 420 is located beneath the toe of the wearer's foot; flat surface region 422 is located beneath the front heel edge 452 of the wearer's foot; and flat surface region 424 is located beneath the heel of the wearer's foot and surrounds stippling region 416. Flat surface region 418 is defined by channel 426 and inside edge 444; flat surface region 420 is defined by channel 429 and toe edge 454; flat surface region 422 is defined by channel 429 and heel front edge 452; and flat surface region 424 is defined by channels 428, 429 and outside edge 442.

As mentioned above, the regions of the outsole surface are separated by channels 426, 427, 428 and 429. The shoe outsole surface also defines notches 430, 432 sloping from the interior of the shoe sole surface toward the outer peripheral edge. The channels and notches together serve to allow water to flow from beneath the shoe outsole surface, thereby permitting gripping engagement of the shoe outsole surface with the wet walking surface during walking motion of the shoe upon the wet walking surface. The channels preferably have a depth of from about 0 to 4 mm.

Figure 19:
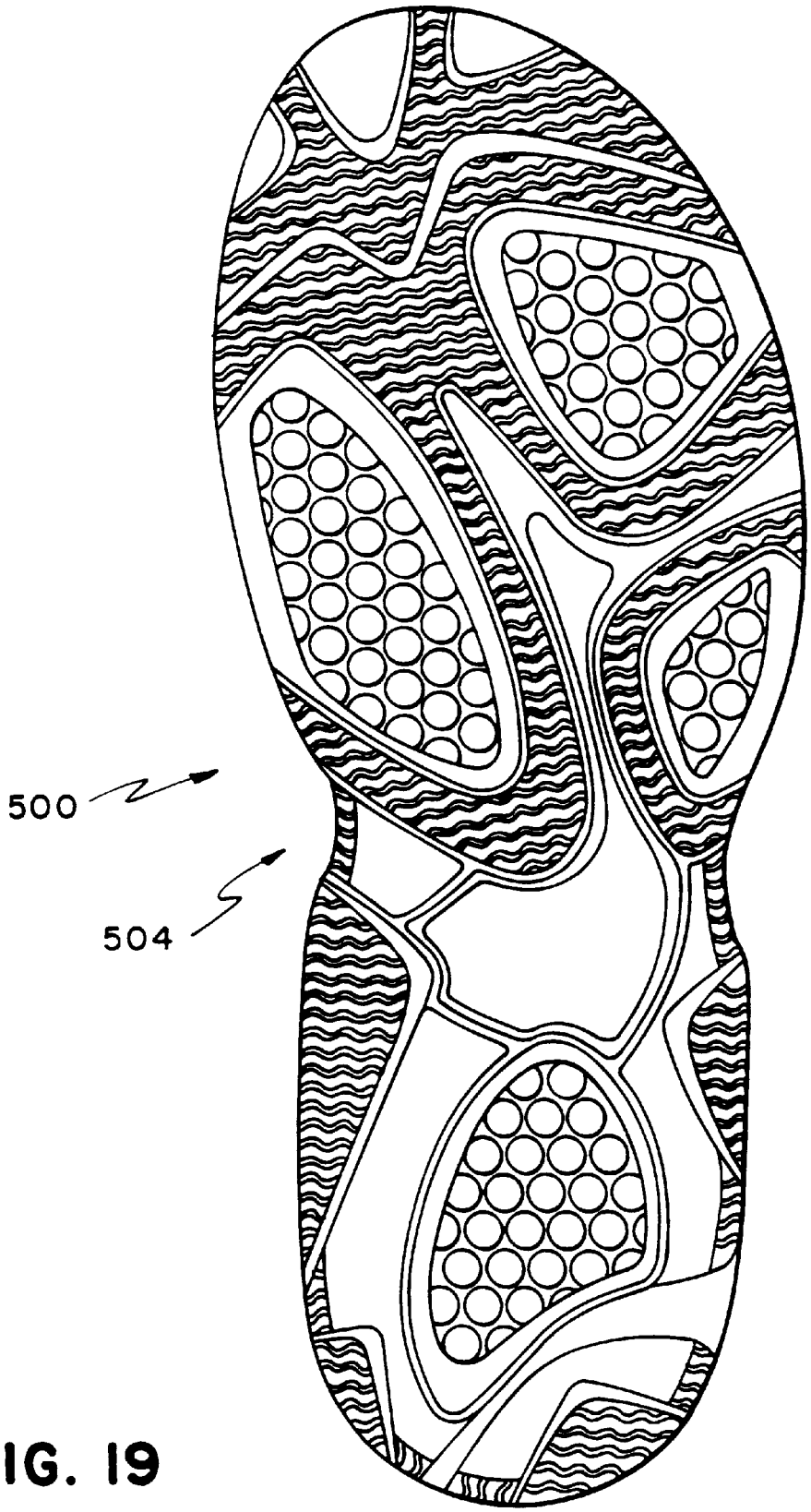
FIG. 19 is a plan view of another embodiment of a shoe outsole of the invention.

In FIG. 19, in another embodiment of the invention, a shoe sole 500 has an outsole surface 504 especially suited for gripping engagement upon a wet walking surface, this embodiment being similar to that described above with respect to FIGS. 7–12.

The shoe sole may be formed of any suitable material employed for shoe soles, preferably a material that is flexible and provides good traction on wet surfaces, e.g., rubber.

Other embodiments are within the following claims.

What is claimed is:

1. A shoe sole defining a shoe outsole surface for gripping engagement upon a wet walking surface, said shoe outsole surface comprising:

channels separating the shoe outsole surface into a plurality of discrete outsole regions, said channels being recessed, relative to the walking surface, from a plane of the shoe outsole surface, thereby to permit flow, from beneath said shoe outsole surface, of water displaced from the wet walking surface by engagement of the shoe outsole surface thereupon, said plurality of discrete outsole regions comprising:

a first outsole region comprising a structural characteristic having a ridged region, said ridged region having a multiplicity of spaced, generally parallel ridges defining opposed, sharp, generally elongated gripping edges disposed generally in said plane of said shoe outsole surface for gripping engagement with the wet walking surface, a second outsole region comprising a structural characteristic having a ridged region, said ridged region having a multiplicity of spaced, generally parallel ridges defining opposed, sharp, generally elongated gripping edges disposed generally in said plane of said shoe outsole surface for gripping engagement with the wet walking surface, a third outsole region comprising a structural characteristic having a stippling region, said stippling region having a multiplicity of spaced apart protrusions extending from a base surface toward the walking surface, each said protrusion defining a circumferential, walking-surface-engaging edge in said plane of said shoe outsole surface, disposed for gripping engagement with the wet walking surface during walking motion of the shoe upon the wet walking surface, said base surface of said stippling region being recessed, relative to the walking surface, from said plane of said shoe outsole surface, said third outsole region having a barrier extending there around and upstanding from the base surface to extend toward said plane of said shoe outsole surface, one of said channels and extending about said barrier, and a fourth outsole region comprising a structural characteristic having a flat surface region, said flat surface region having a relatively smooth, flat surface disposed generally in said plane of said shoe outsole surface for engagement with the wet walking surface during walking motion of the shoe upon the wet walking surface, and said first outsole region and said second outsole region of a common structural characteristic being separated by at least one of said plurality of discrete outsole regions having a different structural characteristic.

2. The shoe sole of claim 1, wherein each said protrusion of said multiplicity of spaced apart protrusions is cylindrical in shape.

3. A shoe sole defining a shoe outsole surface for gripping engagement upon a wet walking surface, said shoe outsole surface comprising:

channels separating the shoe outsole surface into a plurality of discrete outsole regions, said channels being recessed, relative to the walking surface, from a plane of the shoe outsole surface, thereby to permit flow, from beneath said shoe outsole surface, of water displaced from the wet walking surface by engagement of the shoe outsole surface thereupon, said plurality of discrete outsole regions comprising:

a first outsole region comprising a structural characteristic having a ridged region, said ridged region having a multiplicity of spaced, generally parallel ridges defining opposed, sharp, generally elongated gripping edges disposed generally in said plane of said shoe outsole surface for gripping engagement with the wet walking surface, a second outsole region comprising a structural characteristic having a ridged region, said ridged region having a multiplicity of spaced, generally parallel ridges defining opposed, sharp, generally elongated gripping edges disposed generally in said plane of said shoe outsole surface for gripping engagement with the wet walking surface, a third outsole region comprising a structural characteristic having a stippling region, said stippling region having a multiplicity of spaced apart protrusions extending from a base surface toward the walking surface, each said protrusion defining a circumferential, walking-surface-engaging edge in said plane of said shoe outsole surface, disposed for gripping engagement with the wet walking surface during walking motion of the shoe upon the wet walking surface, said base surface of said stippling region being recessed, relative to the walking surface, from said plane of said shoe outsole surface, said third outsole region having a barrier extending thereabout and upstanding from the base surface to extend toward said plane of said shoe outsole surface, with one of said channels extending about said barrier, and a fourth outsole region comprising a structural characteristic having a flat surface region, said flat surface region having a relatively smooth, flat surface disposed generally in said plane of said shoe outsole surface for engagement with the wet walking surface during walking motion of the shoe upon the wet walking surface, and said first outsole region and said second outsole region of a common structural characteristic being separated by at least one of said plurality of discrete outsole regions having a different structural characteristic;

wherein at least one of the ridged regions comprises a siping region having a multiplicity of spaced, generally parallel, wave-form incisions defining opposed, sharp, generally elongated gripping edges disposed generally in said plane of said shoe outsole surface for gripping engagement with the wet walking surface during walking motion of the shoe upon the wet walking surface.

4. The shoe sole of claim 3, wherein said plurality of discrete outsole regions comprises a plurality of discrete siping regions separated by said channels.

5. A shoe sole defining a shoe outsole surface for gripping engagement upon a wet walking surface, said shoe outsole surface comprising:

channels separating the shoe outsole surface into a plurality of discrete outsole regions, said channels being recessed, relative to the walking surface, from a place of the shoe outsole surface, thereby to permit flow from beneath said shoe outsole surface of water displaced from the wet walking surface by engagement of the shoe outsole surface thereupon, said plurality of discrete outsole regions comprising:

a first outsole region comprising a structural characteristic having a ridged region, said ridged region having a multiplicity of spaced, generally parallel, ridges defining opposed, sharp, generally elongated gripping edges disposed generally in said plane of said shoe outsole surface for gripping engagement with the wet walking surface, a second outsole region comprising a structural characteristic having a stippling region, said stippling region having a multiplicity of spaced apart protrusions extending from a base surface toward the walking surface, each said protrusion defining a circumferential, walking-surface-engaging edge disposed for gripping engagement with the wet walking surface during walking motion of the shoe upon the wet walking surface, said base surface of said stippling region being recessed, relative to the walking surface, from said plane of said shoe outsole surface, a third outsole region comprising a structural characteristic having a stippling region, said stippling region having a multiplicity of spaced apart protrusions extending from a base surface toward the walking surface, each said protrusion defining a circumferential, walking-surface-engaging edge in said plane of said shoe outsole surface, disposed for gripping engagement with the wet walking surface during walking motion of the shoe upon the wet walking surface, said base surface of said stippling region being recessed, relative to the walking surface, from said plane of said shoe outsole surface, said third outsole region being having a barrier extending thereabout and upstanding from the base surface to extend toward said plane of said shoe outsole surface, with one of said channels extending about said barrier, and a fourth outsole region comprising a structural characteristic having a relatively smooth, flat surface disposed generally in said plane of said shoe outsole surface for engagement with the wet walking surface during walking motion of the shoe upon the wet walking surface, and said second outsole region and said third outsole region of a common structural characteristic being separated by at least one of the plurality of discrete outsole regions having a different structural characteristic.

6. The shoe sole of claim 5, wherein each said protrusion of said multiplicity of spaced apart protrusions is cylindrical in shape.

7. A shoe sole defining a shoe outsole surface for gripping engagement upon a wet walking surface, said shoe outsole surface comprising:

channels separating the shoe outsole surface into a plurality of discrete outsole regions, said channels being recessed, relative to the walking surface, from a place of the shoe outsole surface, thereby to permit flow from beneath said shoe outsole surface of water displaced from the wet walking surface by engagement of the shoe outsole surface thereupon, said plurality of discrete outsole regions comprising:

a first outsole region comprising a structural characteristic having a ridged region, said ridged region having a multiplicity of spaced, generally parallel, ridges defining opposed, sharp, generally elongated gripping edges disposed generally in said plane of said shoe outsole surface for gripping engagement with the wet walking surface, a second outsole region comprising a structural characteristic having a stippling region, said stippling region having a multiplicity of spaced apart protrusions extending from a base surface toward the walking surface, each said protrusion defining a circumferential, walking-surface-engaging edge disposed for gripping engagement with the wet walking surface during walking motion of the shoe upon the wet walking surface, said base surface of said stippling region being recessed, relative to the walking surface, from said plane of said shoe outsole surface, a third outsole region comprising a structural characteristic having a stippling region, said stippling region having a multiplicity of spaced apart protrusions extending from a base surface toward the walking surface, each said protrusion defining a circumferential, walking-surface-engaging edge in said plane of said shoe outsole surface, disposed for gripping engagement with the wet walking surface during walking motion of the shoe upon the wet walking surface, said base surface of said stippling region being recessed, relative to the walking surface, from said plane of said shoe outsole surface, said third outsole region having a barrier extending thereabout and upstanding from the base surface to extend toward said plane of said shoe outsole surface, and one of said channels extending about said barrier, and a fourth outsole region comprising a structural characteristic having a relatively smooth, flat surface disposed generally in said plane of said shoe outsole surface for engagement with the wet walking surface during walking motion of the shoe upon the wet walking surface, and said second outsole region and said third outsole region of a common structural characteristic being separated by at least one of the plurality of discrete outsole regions having a different structural characteristic, wherein at least one of the ridged regions comprises a siping region having a multiplicity of spaced, generally parallel, wave-form incisions defining opposed, sharp, generally elongated gripping edges disposed generally in said plane of said shoe outsole surface for gripping engagement with the wet walking surface during walking motion of the shoe upon the wet walking surface.

8. The shoe sole of claim 7, wherein said plurality of discrete outsole regions comprises a plurality of discrete siping regions separated by said channels.

9. A shoe sole defining a shoe outsole surface for gripping engagement upon a wet walking surface, said shoe outsole surface comprising:

channels separating the shoe outsole surface into a plurality of discrete outsole regions, said channels being recessed, relative to the walking surface, from a plane of the shoe outsole surface, thereby to permit flow from beneath said shoe outsole surface of water displaced from the wet walking surface by engagement of the shoe outsole surface thereupon, said plurality of discrete outsole regions comprising:

a first outsole region having a first walking surface engaging structural characteristic, a second outsole region having a second walking surface engaging structural characteristic, said second walking surface engaging structural characteristic being different from said first walking surface engaging structural characteristic, a third outsole region having a third walking surface engaging structural characteristic, said third walking surface engaging structural characteristic being different from each of said first walking surface engaging structural characteristic and said second walking surface engaging structural characteristic, said first, second, and third walking surface engaging structural characteristics being selected from:

a ridged region having a multiplicity of spaced, generally parallel, ridges defining opposed, sharp, generally elongated engaging edges disposed generally in said plane of said shoe outsole surface for gripping engagement with the wet walking surface, a stippling region having a multiplicity of spaced apart protrusions extending from a base surface toward the walking surface, each said protrusion defining a circumferential, walking-surface-engaging edge disposed for gripping engagement with the wet walking surface during walking motion of the shoe upon the wet walking surface, said base surface of said stippling region being recessed, relative to the walking surface, from said plane of said shoe outsole surface, and a stippling region having a multiplicity of spaced apart protrusions extending from a base surface toward the walking surface, each said protrusion defining a circumferential, walking-surface-engaging edge in said plane of said shoe outsole surface, disposed for gripping engagement with the wet walking surface during walking motion of the shoe upon the wet walking surface, said base surface of said stippling region being recessed, relative to the walking surface, from said plane of said shoe outsole surface, said stippling region a barrier extending thereabout and upstanding from the base surface to extend toward said plane of said shoe outsole surface, with one of said channels extending about said barrier, and a flat surface region having a relatively smooth, flat surface disposed generally in said plane of said shoe outsole surface for engagement with the wet walking surface during walking motion of the shoe upon the wet walking surface, said plurality of discrete outsole regions further comprising:

a fourth outsole region having a walking surface engaging structural characteristic in common with said first outsole region and being separated therefrom by at least one of said plurality of discrete outsole regions having a different walking surface engaging structural characteristic.

10. The shoe sole of claim 9, wherein the first outsole region and the fourth outsole region have a surface engaging structural characteristics which is ridged.

11. The shoe sole of claim 10, wherein the first outsole region and the fourth outsole region are separated by an outsole region having a surface engaging structural characteristic which is stippled.

12. The shoe sole of claim 9, wherein the first outsole region and the fourth outsole region are separated by an outsole region having a surface engaging structural characteristic which is flat.

13. The shoe sole of claim 9, wherein the first outsole region and the fourth outsole region have a surface engaging structural characteristic which is stippled.

14. The shoe sole of claim 13, wherein the first outsole region and the fourth outsole region are separated by an outsole region having a surface engaging structural characteristic which is ridged.

15. The shoe sole of claim 13, wherein the first outsole region and the fourth outsole region are separated by an outsole region having a surface engaging structural characteristic which is flat.

16. The shoe sole of claim 9, wherein the first outsole region and the fourth outsole region have a surface engaging structural characteristics which is flat.

17. The shoe sole of claim 16, wherein the first outsole region and the fourth outsole region are separated by an outsole region having a surface engaging structural characteristic which is ridged.

18. The shoe sole of claim 9, wherein the ridged region comprises a siping region having a multiplicity of spaced, generally parallel, wave-form incisions defining opposed, sharp, generally elongated gripping edges disposed generally in said plane of said shoe outsole surface for gripping engagement with the wet walking surface during walking motion of the shoe upon the wet walking surface.

19. The shoe sole of claim 18, wherein said plurality of discrete outsole regions comprises a plurality of discrete siping regions separated by said channels.

20. The shoe sole of claim 9, wherein each said protrusion of said multiplicity of spaced apart protrusions is cylindrical in shape.

* * * * *

UNITED STATES PATENT AND TRADEMARK OFFICE

CERTIFICATE OF CORRECTION

PATENT NO. : 6,076,283
DATED : June 20, 2000
INVENTOR(S) : Jason C. Boie

It is certified that error appears in the above-identified patent and that said Letters Patent is hereby corrected as shown below:

Column 4,
Line 66, after "$R_1$'" insert -- to --.

Signed and Sealed this

Twenty-fourth Day of September, 2002

*Attest:*

*Attesting Officer*

JAMES E. ROGAN
*Director of the United States Patent and Trademark Office*